US006478617B2

(12) United States Patent
Fan

(10) Patent No.: US 6,478,617 B2
(45) Date of Patent: Nov. 12, 2002

(54) SOLDERING STRUCTURE FOR AN ELECTRICAL CONNECTOR

(75) Inventor: Chia Hao Fan, Shu-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/948,990

(22) Filed: Sep. 7, 2001

(65) Prior Publication Data

US 2002/0042224 A1 Apr. 11, 2002

(30) Foreign Application Priority Data

Oct. 9, 2000 (TW) ..... 89217539 U

(51) Int. Cl.[7] ..... H01R 13/73
(52) U.S. Cl. ..... 439/570; 439/573
(58) Field of Search ..... 439/570–573, 439/569, 563, 564, 567, 108

(56) References Cited

U.S. PATENT DOCUMENTS 5,395,265 A * 3/1995 DiMondi et al. ..... 439/566
6,042,420 A * 3/2000 Long ..... 439/570
6,227,906 B1 * 5/2001 Fan ..... 439/570
6,254,429 B1 * 7/2001 Morita ..... 439/570

* cited by examiner

*Primary Examiner*—Hien Vu
(74) *Attorney, Agent, or Firm*—Wei Te Chung

(57) ABSTRACT

A connector includes a housing, a plurality of electrical contacts and a pair of soldering pieces. The housing has two side walls, a bottom wall, an engaging portion formed on each side wall and defining a mounting channel extending downwardly to the bottom wall, and a projection is formed on the bottom wall. The electrical contacts are mounted in the housing with one end of each contact extending outwardly from the housing to engage with the PCB. Each soldering piece comprises a planar base and an engaging flake vertical to the planar base. The planar base is mounted in the channel and the engaging flake abuts against the projection.

2 Claims, 3 Drawing Sheets

SOLDERING STRUCTURE FOR AN ELECTRICAL CONNECTOR

BACKGROUND OF THE INVENTION

1. Field of the Invention

The present invention relates to an electrical connector mounted on circuit board by SMT (Surface Mount Technology), and particularly to an electrical connector having improved soldering pieces.

2. Brief Description of the Prior Art

Electrical connectors generally include an insulative housing and a mounting portion which mounts on the print circuit board (PCB). Traditionally, the mounting portion is inserted into a hole formed on the PCB and then is soldered on the board by SMT.

Traditionally, the mounting portion includes a mounting flange and a base. The mounting flange is mounted on the insulative housing. The base is soldered on the PCB. As the base is made of sheet metal and suspended outside the insulative housing, it is easy to be deformed by unexpected external force. Example of electrical connector with similar structure is that disclosed in U.S. Pat. No. 6,042,420.

Hence, an improved electrical connector is required to overcome the disadvantages of the prior art. Other improvement approaches can be found in U.S. Pat. No. 6,227,906 and the application Ser. No. 09/752,890 filed on Dec. 28, 2000, now U.S. Pat. No. 6,317,803, of which both have the same inventor and the same assignee with the instant invention.

BRIEF SUMMARY OF THE INVENTION

The object of the present invention is to provide an electrical connector with a soldering piece not easy to be deformed by unexpected external force.

To achieve the above-mentioned objects, a connector in accordance with the present invention includes a housing, a plurality of electrical contacts and a pair of soldering pieces. The housing has two side walls, a bottom wall, an engaging portion formed on each side wall and defining a mounting channel extending downwardly to the bottom wall, and a pair of projections is formed on the bottom wall. The electrical contacts are mounted in the housing with one end of each contact extending outwardly from the housing to engage with the PCB. Each soldering piece comprises a planar base and an engaging flake vertical to the planar base. The planar base is mounted in the channel and the engaging flake abuts against the projection.

Other objects, advantages and novel features of the present invention will become more apparent from the following detailed description of the present embodiment when taken in conjunction with the accompanying drawings.

DETAILED DESCRIPTION OF THE INVENTION

Figure 1:
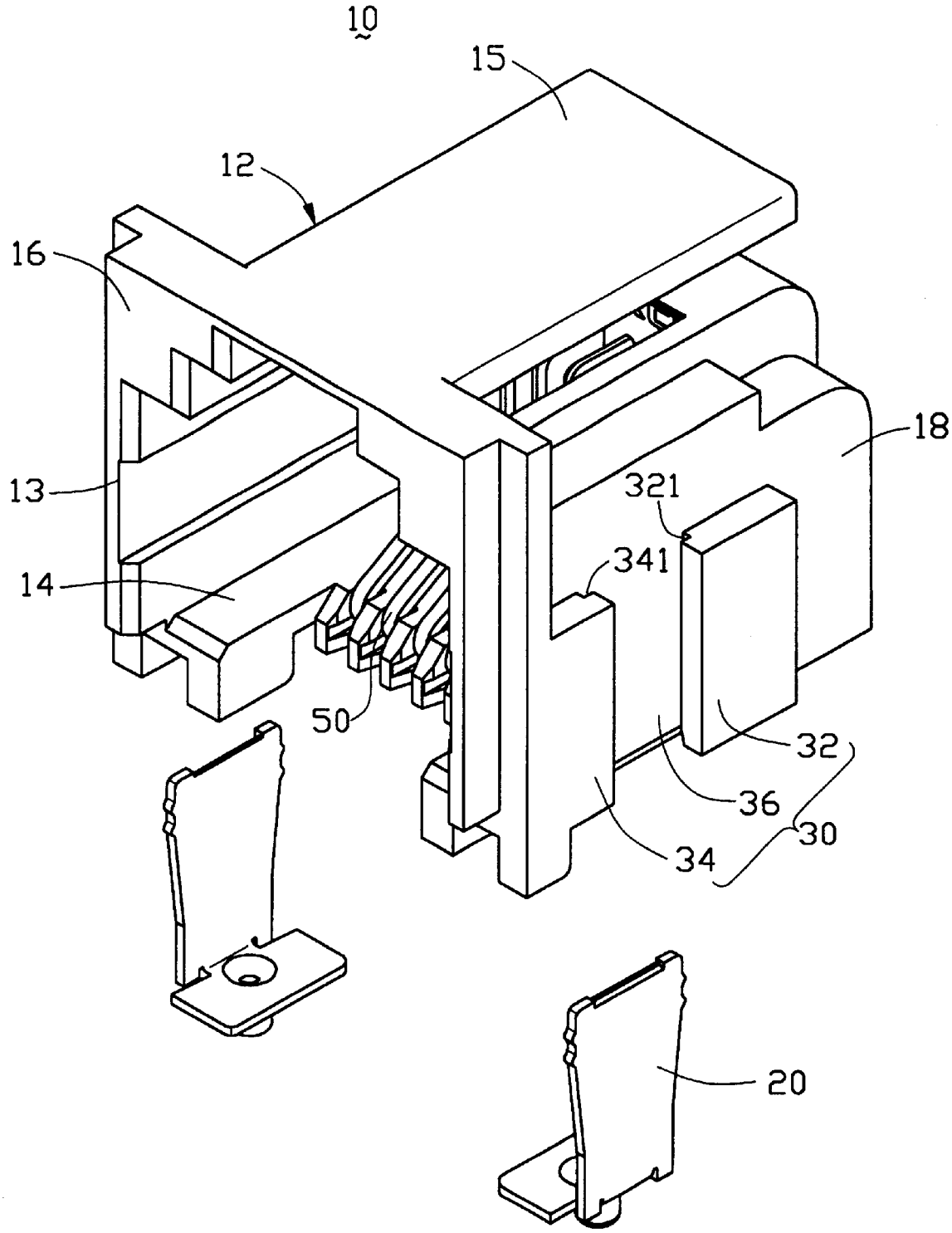
FIG. 1 is an exploded view of an electrical connector in accordance with the present invention.
Figure 3:
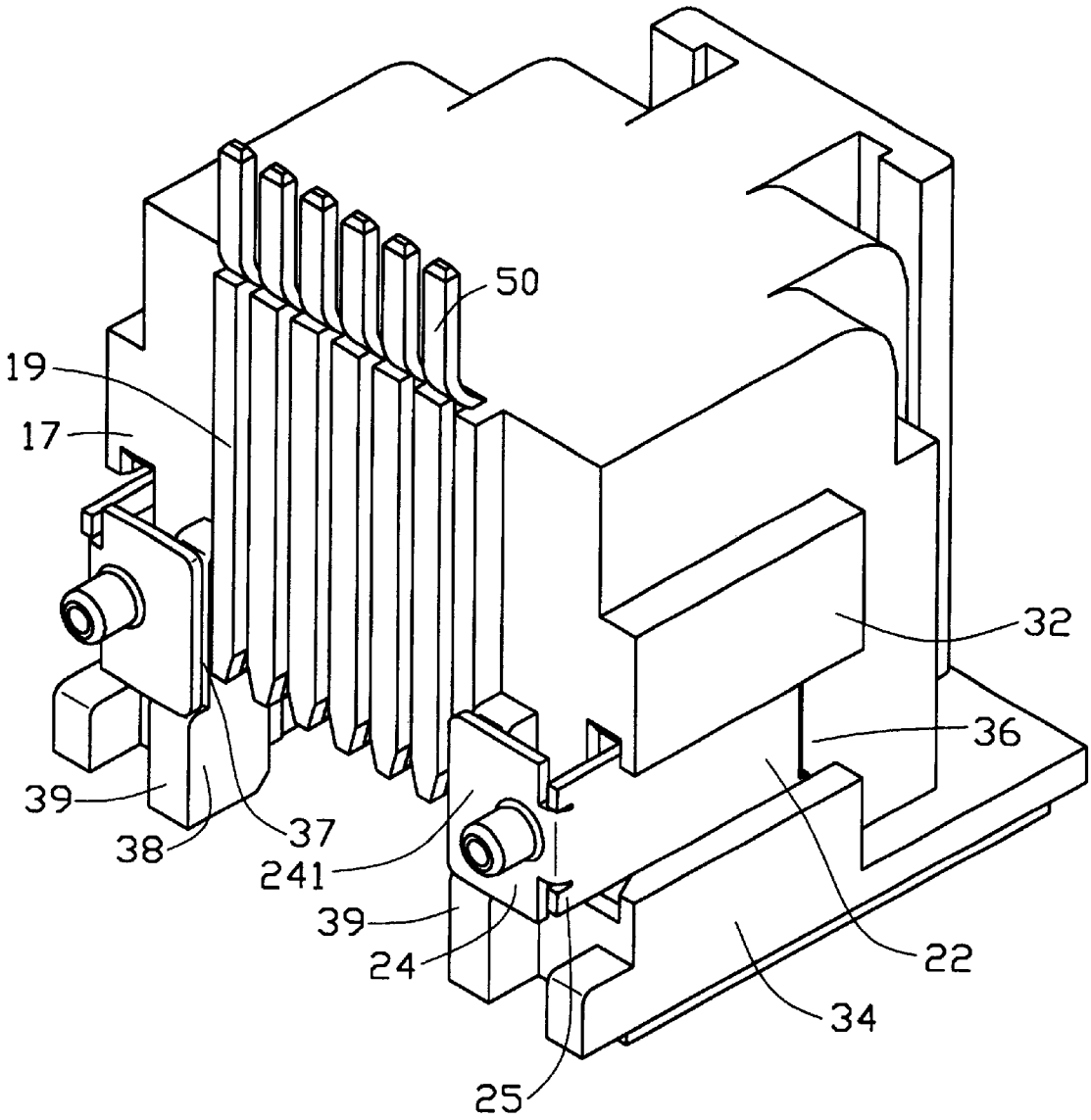
FIG. 3 is a perspective view of an electrical connector in accordance with the present invention.

Referring to FIGS. 1 and 3, an electrical connector 10 in accordance with the present invention comprises a housing 12, a pair of soldering pieces 20 and a plurality of electrical contacts 50. The housing 12 comprises a front surface 13, a top wall 15, a bottom wall 17 having a mounting face 19 formed thereon, and two opposite side walls 18. An engaging board 16 is formed on the front surface 13 with an opening 14 extending inwardly. The electrical contacts 50 are mounted in the housing 12, one end of the contact 50 extending into the opening 14 for connecting with the engaging portion of the complementary electrical connector, the other end of the contact extending outwardly from the housing 12 and bended to be coplanar with the mounting face 19. An engaging portion 30 is formed on each side wall 18 near the engaging board 16. The engaging portion 30 comprises two elongate blocks 32, 34 and a mounting channel 36 formed therebetween. Two opposite slots 321, 341 are formed on the blocks 32, 34 and abut on the side wall 18. So the mounting channel 36 is formed T-shaped by the blocks 32, 34, the slots 321, 341 and the side wall 18 for receiving the soldering piece 20. A pair of projections 38 are formed downwardly on the bottom wall 17, each near one mounting channel 36. Each projection 38 includes a base portion 37 and a step 39.

Figure 2:
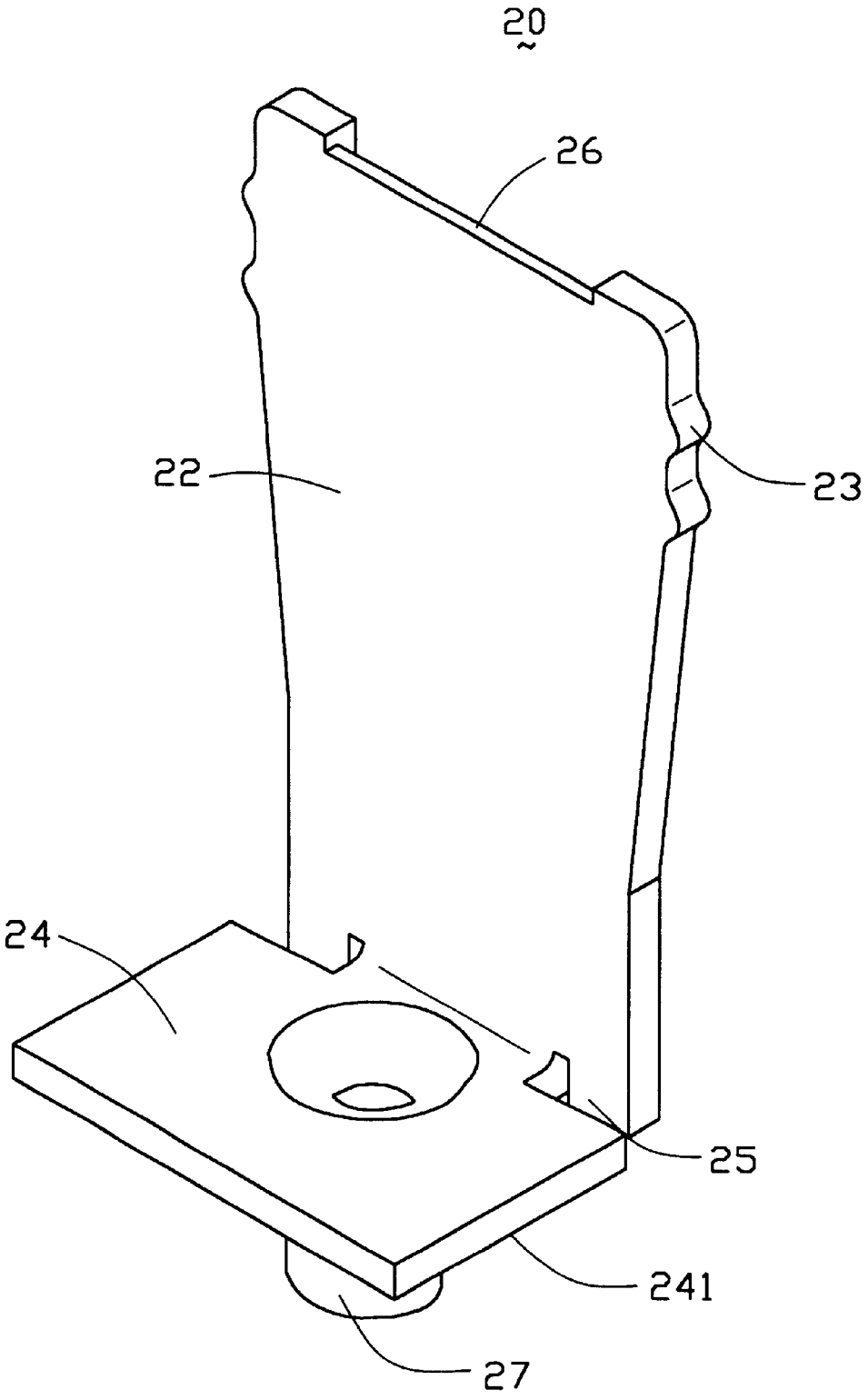
FIG. 2 is a perspective view of a soldering piece.

Referring to FIG. 2, the L-shaped soldering piece 20 includes a planar base 22 and a vertical engaging flake 24. The base 22 includes a top edge 26 and a plurality of rims 23 formed on two side edges of base 23 near the top edge 26. When the soldering piece 20 engages into the mounting channel 36, the rims 23 interference fit with the slots 321, 341 to securely maintain the soldering piece 20 in the channel 36. A pair of flanges 25 extends downwardly near the engaging flake 24. The engaging flake 24 includes an undersurface 241 and a positioning pole 27 extending downwardly from the undersurface 241 for securely maintaining the electrical connector at certain position.

Referring to FIG. 3, the base 22 of the soldering piece 20 is mounted on the connector upwardly along the mounting channel 36. The rims 23 are received into the slots 321, 341. Also, the engaging flake 24 is moved upwardly until abutting on the base portion 37 of the projection 38. When pressed by unexpected external force, the engaging flake 24 bears on the projection 38 and will not be deformed, so this structure provides a good soldering effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mountable on a printed circuit board, said connector comprising:

an insulative housing;

a plurality of contacts disposed in the housing;

a pair of mounting channels, each being formed by two blocks and extending vertically on two sides of the housing, respectively;

a pair of projections formed on a bottom surface of the housing adjacent to the corresponding mounting channels, respectively; and a pair of soldering pieces each including a vertical base retained in the corresponding mounting channel, a pair flanges extending downwardly from each side of a bottom edge of the said base, a horizontal engaging flake integrally extending from the bottom edge of the base with an upper face abutting against the corresponding projection, and a positioning pole extending downwardly from the engaging flake.

2. The connector as claimed in claim 1, wherein said engaging flakes of the pair of soldering pieces are inwardly bent toward each other.

* * * * *